United States Patent [19]

Wisotsky

[11] 4,175,926

[45] Nov. 27, 1979

[54] POLYMER COMBINATION USEFUL IN FUEL OIL TO IMPROVE COLD FLOW PROPERTIES

[75] Inventor: Max J. Wisotsky, Highland Park, N.J.

[73] Assignee: Exxon Research & Engineering Co., Florham Park, N.J.

[21] Appl. No.: 869,647

[22] Filed: Jan. 16, 1978

Related U.S. Application Data

[63] Continuation of Ser. No. 715,530, Aug. 18, 1976, abandoned, which is a continuation of Ser. No. 507,242, Sep. 18, 1974, abandoned, which is a continuation-in-part of Ser. No. 411,482, Oct. 31, 1973, abandoned.

[51] Int. Cl.[2] ..... C10L 1/18

[52] U.S. Cl. ..... 44/62; 44/70

[58] Field of Search ..... 44/62, 70

[56] References Cited

U.S. PATENT DOCUMENTS 4,010,006 10/1973 Price ..... 44/62

*Primary Examiner*—Winston A. Douglas
*Assistant Examiner*—Y. Harris-Smith
*Attorney, Agent, or Firm*—Frank T. Johmann

[57] ABSTRACT

Ethylene polymers or copolymers, which are pour depressants for middle distillate fuel, in combination with a second polymer having alkyl groups of 6 to 18 carbon atoms, and derived from either dicarboxylic acid esters or olefins, are useful in improving the cold flow properties of middle distillate fuel oils wherein a portion, e.g., 5 wt. % or more, of the fuel boils above 700° F.

10 Claims, No Drawings

POLYMER COMBINATION USEFUL IN FUEL OIL TO IMPROVE COLD FLOW PROPERTIES

CROSS-REFERENCE TO RELATED APPLICATION

This application is a continuation of Ser. No. 715,530 filed Aug. 18, 1976, now abandoned, which was a continuation of Ser. No. 507,242 filed Sept. 18, 1974, now abandoned, which was a continuation-in-part of Ser. No. 411,482 filed Oct. 31, 1973, now abandoned.

BACKGROUND OF THE INVENTION

1. Field of the Invention

The invention relates to an additive combination of (a) an ethylene backbone middle distillate fuel oil pour depressant polymer with (b) a second polymer having alkyl side chains of 6 to 18 carbon atoms defined by dicarboxylic acid ester or olefin moieties. This combination is particularly useful in middle distillate fuel oils containing a fraction boiling above 700° F., for controlling the size of wax crystals that form at low temperatures.

2. Description of the Prior Art

Various polymers, useful as middle distillate pour point depressants, prepared from ethylene have been described in the patent literature. These pour depressants include copolymers of ethylene and vinyl esters of lower fatty acids such as vinyl acetate (U.S. Pat. No. 3,048,479); copolymers of ethylene and alkyl acrylate (Canadian Patent No. 676,875); terpolymers of ethylene with vinyl esters and alkyl fumarates (U.S. Pat. Nos. 3,304,261 and 3,341,309); polymers of ethylene with other lower olefins, or homopolymers of ethylene (British Pat. Nos. 848,777 and 993,744); chlorinated polyethylene (Belgian Pat. No. 707,371 and U.S. Pat. No. 3,337,313); etc.

Polymers having alkyl groups in the range of $C_6$ to $C_{18}$, such as homopolymers and copolymers of olefins; alkyl esters of unsaturated dicarboxylic acids (e.g., copolymers of dialkyl fumarate with vinyl acetate) and copolymers of olefins and said esters, are known in the art principally as lube oil pour depressants and/or V.I. improvers. For example, U.S. Pat. No. 2,379,728 teaches olefin polymers as lube pour depressants; U.S. Pat. No. 2,460,035 shows polyfumarates; U.S. Pat. No. 2,936,300 shows a copolymer of dialkyl fumarate and vinyl acetate; while U.S. Pat. No. 2,542,542 teaches copolymers of olefins, such as octadecene with maleic anhydride esterified with alcohol, e.g., lauryl alcohol, in lube and heating oils.

Synergistic pour point depressing combinations of various members of the above-noted two types of polymers in heavy fuels, e.g., residua and flash distillate fuels, which fuels contain relatively large amounts of waxes having 20 or more carbon atoms, is taught in U.S. Pat. No. 3,726,653.

THE INVENTION

The present invention is based on finding that ethylene polymers in combination with a second polymer which is a polymer of an olefin or unsaturated dicarboxylic acid ester, said second polymer having straight chain alkyl groups of 6 to 18 carbon atoms, can give synergistic results in controlling wax crystal size in light, low viscosity, fuel oils having a fraction boiling above 700° F., and which do not have large amounts of n-paraffin waxes having 20 or more carbon atoms.

In general, the additive combination of the invention will comprise one part by weight of the ethylene polymer per about 0.1 to 20, preferably 0.2 to 4 parts by weight of said second polymer. The light, middle distillate, fuel oil compositions of the invention will contain a total of about 0.001 to 1.0, preferably, 0.005 to 0.1 wt. % of said additive combination. Concentrates of 1 to 60 wt. % of said additive combination in 40 to 99 wt. % of mineral oil, e.g., kerosene, can be prepared for ease of handling. The light distillate fuel of the invention will have a viscosity in the range of 1.6 to 7.5 centistokes at 100° F. and will have less than 3 wt. % usually less than 1 wt. %, of wax boiling above 350° C., i.e., wax having 20 or more carbon atoms.

The Ethylene Polymer

The ethylene polymers will have a polymethylene backbone which is divided into segments by hydrocarbon or oxy-hydrocarbon side chains. They may be simply homopolymers of ethylene, usually prepared by free radical polymerization which will result in some branching. More usually, they will comprise about 3 to 40, preferably 4 to 20, molar proportions of ethylene per molar proportion of a second ethylenically unsaturated monomer, which latter monomer can be a single monomer or a mixture of such monomers in any proportion. These polymers will generally have a number average molecular weight in the range of about 500 to 50,000, preferably about 800 to about 20,000, e.g., 1000 to 6000, as measured for example by Vapor Pressure Osmometry (VPO), such as using a Mechrolab Vapor Pressure Osmometer Model 302B.

The unsaturated monomers, copolymerizable with ethylene, include unsaturated mono and diesters of the general formula:

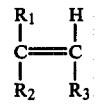

wherein $R_1$ is hydrogen or methyl; $R_2$ is a —$OOCR_4$ or —$COOR_4$ group wherein $R_4$ is hydrogen or a $C_1$ to $C_{16}$, preferably a $C_1$ to $C_4$, straight or branched chain alkyl group; and $R_3$ is hydrogen or —$COOR_4$. The monomer, when $R_1$ and $R_3$ are hydrogen and $R_2$ is —$OOCR_4$, includes vinyl alcohol esters of $C_2$ to $C_{17}$ monocarboxylic acid, preferably $C_2$ to $C_5$ monocarboxylic acid. Examples of such esters include vinyl acetate, vinyl isobutyrate, vinyl laurate, vinyl myristate, vinyl palmitate, etc. When $R_2$ is —$COOR_4$ and $R_3$ is hydrogen, such esters include methyl acrylate, isobutyl acrylate, methyl methacrylate, lauryl acrylate, $C_{13}$ Oxo alcohol esters of methacrylic acid, etc. Examples of monomers where $R_1$ is hydrogen and $R_2$ and $R_3$ are —$COOR_4$ groups, include mono and diesters of unsaturated dicarboxylic acids such as: mono $C_{13}$ Oxo fumarate, di-$C_{13}$ Oxo fumarate, di-isopropyl maleate; di-lauryl fumarate; ethyl methyl fumarate; etc.

Another class of monomers that can be copolymerized with ethylene include $C_3$ to $C_{16}$ alpha monoolefins, which can be either branched or unbranched, such as propylene, isobutene, n-octene-1, isooctene-1, n-decene-1, dodecene-1, etc.

Still other monomers include vinyl chloride, although essentially the same result can be obtained by chlorinating polyethylene, e.g., to a chlorine content of about 10 to 35 wt. %. Or, as previously mentioned, branched polyethylene can be used per se as the pour depressant.

These oil soluble ethylene polymer pour depressants are generally formed using a free radical promoter, or in some cases they can be formed by thermal polymerization, or they can be formed by Ziegler catalysis in the case of ethylene with other olefins. The polymers produced by free radical appear to be the more important and can be formed as follows: Solvent, and 0–50 wt. %, of the total amount of monomer other than ethylene; e.g., an ester monomer, used in the batch, are charged to a stainless steel pressure vessel which is equipped with a stirrer. The temperature of the pressure vessel is then brought to the desired reaction temperature, e.g., 70° to 250° C., and pressured to the desired pressure with ethylene, e.g., 600 to 10,000 psig., usually 900 to 6,000 psig. Preferred are temperatures in the range of 70° to 135° C. for these low temperatures of polymerization result in a more linear polymer with less ethylene side branching, which more linear polymers usually appear more effective in the fuels of the invention than similar polymers prepared at higher polymerization temperatures. Promoter, usually dissolved in solvent so that it can be pumped, and additional amounts of the second monomer (if any), e.g., unsaturated ester, can be added to the vessel continuously, or at least periodically, during the reaction time, which continuous or periodic addition gives a more homogeneous copolymer product as compared to adding all the unsaturated ester at the beginning of the reaction. Also during this reaction time, as ethylene is consumed in the polymerization reaction, additional ethylene can be supplied through a pressure controlling regulator so as to maintain the desired reaction pressure fairly constant at all times. Following the completion of the reaction, usually a total reaction time of ¼ to 10 hours will suffice, the liquid phase of the pressure vessel contents is distilled to remove the solvent and other volatile constituents of the reacted mixture, leaving the polymer as residue. Usually to facilitate handling and later oil blending, the polymer is dissolved in a light mineral oil to form a concentrate usually containing 10 to 60 wt. % of polymer.

Usually, based upon 100 parts by weight of polymer to be produced, then about 50 to 1200, preferably 100 to 600 parts by weight of solvent, usually a hydrocarbon solvent such as benzene, hexane, cyclohexane, etc., and about 1 to 20 parts by weight of promoter will be used.

The promoter can be any of the conventional free radical promoters, such as peroxide or azo-type promoters, including the acyl peroxides of $C_2$ to $C_{18}$ branched or unbranched carboxylic acids, as well as other common promoters. Specific examples of such promoters include dibenzoyl peroxide, di-tertiary butyl peroxide, tertiary butyl perbenzoate, tertiary butyl hydroperoxide, alpha, alpha', azo-diisobutyronitrile, di-lauroyl peroxide, etc. Di-lauroyl peroxide is preferred when the polymer is made at a low temperature, e.g., 70° to 135° C., while di-tert. butyl peroxide is preferred at higher polymerization temperatures.

The Second Polymer

These oil soluble polymers will generally have a number average molecular weight in the range of about 1000 to 100,000, preferably 1,000 to 30,000 as measured, for example, by Vapor Pressure Osmometry such as by a Mechrolab Vapor Pressure Osmometer. Usually at least about 25 wt. % of the polymer will be in the form of straight chain alkyl groups of an alpha olefin or a dicarboxylic acid ester, said alkyl groups having 6 to 18, e.g., 8 to 16, carbon atoms. These second polymers include (a) polymers containing alkyl ester of an unsaturated $C_4$ to $C_8$ dicarboxylic acid, including copolymers with other esters or with olefins, and (b) olefin polymers and copolymers.

The dicarboxylic acid esters useful for preparing the second polymer can be represented by the general formula:

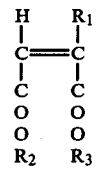

wherein $R_1$ is hydrogen or a $C_1$ to $C_4$ alkyl group, e.g., methyl, $R_2$ is a $C_6$ to $C_{18}$, e.g., $C_8$ to $C_{16}$, straight chain alkyl group, and $R_3$ is hydrogen or $R_2$. Preferred examples of such esters include fumarate and maleate esters such as dilauryl fumarate, lauryl-hexadecyl fumarate, lauryl maleate, etc.

The dicarboxylic acid mono or di-ester monomers described above may be copolymerized with various amounts, e.g., 5 to 70 mole %, of other unsaturated esters or olefins. Such other esters include short chain alkyl esters having the formula:

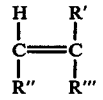

where R' is hydrogen or a $C_1$ to $C_4$ alkyl group, R'' is —COOR'''' or —OOCR'''' where R'''' is a $C_1$ to $C_5$ alkyl group, branched or unbranched, and R''' is R'' or hydrogen. Examples of these short chain esters are methacrylates, acrylates, fumarates, maleates, vinylates, etc. More specific examples include methyl acrylate, isopropyl acrylate, vinyl acetate, vinyl propionate, vinyl butyrate, methyl methacrylate, isopropenyl acetate, isobutyl acrylate, etc.

Examples of still other unsaturated esters, which can be copolymerized with the unsaturated dicarboxylic acid esters, are $C_6$ to $C_{18}$, e.g., $C_8$–$C_{16}$, alkyl acrylates and methacrylates, e.g., n-octyl acrylate, n-decyl methacrylate, hexadecyl methacrylate, etc.

The ester polymers are generally prepared by polymerizing the ester monomers in a solution of a hydrocarbon solvent such as heptane, benzene, cyclohexane, or white oil, at a temperature generally in the range of from 60° F. to 250° F. and usually promoted with a peroxide type catalyst such as benzoyl peroxide, under a blanket of an inert gas such as nitrogen or carbon dioxide in order to exclude oxygen.

The unsaturated dicarboxylic acid mono or di-ester can also be copolymerized with an alpha-olefin. However, it is usually easier to polymerize the olefin with the dicarboxylic acid or its anhydride, and then esterify with 1 to 2 molar proportions of alcohol per mole of dicarboxylic acid or anhydride. To further illustrate, the ethylenically unsaturated dicarboxylic acid or anhydride or derivative thereof is reacted with a $C_6$ to $C_{18}$ olefin, by mixing the olefin and acid, or anhydride, e.g., maleic anhydride, usually in about equi-molar amounts, and heating to a temperature of at least 180° F., preferably at least 250° F. A free radical polymerization promoter such as t-butyl hydroperoxide or di-t-butyl peroxide is normally used. The resulting copolymer thus prepared is then esterified with alcohol.

Another useful class of said second polymer are olefin polymers, which can be either homopolymers of long chain $C_8$ to $C_{20}$, preferably $C_{10}$ to $C_{18}$, aliphatic alpha-monoolefins or copolymers of said long chain alpha monoolefins with shorter chain $C_3$–$C_7$ aliphatic alpha-olefins or with styrene or its derivatives, e.g., copolymers comprising 20 to 90 wt. % of said $C_{10}$ to $C_{18}$ alpha-olefin and 10 to 80 wt. % of said $C_3$ to $C_7$ aliphatic monoolefin, or styrene-type olefin.

Examples of such monomers include propylene, butene-1, hexane-1, octene-1, decene-1, 3-methyl decene-1, tetradecene-1, styrene and styrene derivatives such as p-methyl styrene, p-isopropyl styrene, alpha-methyl styrene, etc.

These olefin polymers may be conveniently prepared by polymerizing the monomers under relatively mild conditions of temperature and pressure in the presence of an organo-metallic catalyst, i.e., a mixture of a compound derived from a Group IV, V or VI metal of the Periodic Table in combination with an organometallic compound of a Group I, II or III metal of the Periodic Table, wherein the amount of the compound derived from a Group IV–VI metal may range from 0.01 to 2.0 moles per mole of the organometallic compound.

Effective catalysts for polymerizing the olefin monomers of the invention include the following combinations: aluminum triisobutyl and vanadium trichloride; aluminum triisobutyl, aluminum chloride, and vanadium trichloride; vanadium tetrachloride and aluminum trihexyl; vanadium trichloride and aluminum trihexyl; vanadium triacetylacetonate and aluminum diethyl chloride; titanium tetrachloride and aluminum trihexyl; vanadium trichloride and aluminum trihexyl; titanium trichloride and aluminum trihexyl; titanium dichloride and aluminum trihexyl, etc.

The polymerization is usually carried out by mixing the catalyst components in an inert diluent such as a hydrocarbon solvent, e.g., hexane, benzene, toluene, xylene, heptane, etc., and then adding the monomers into the catalyst mixture at atmospheric or superatmospheric pressures and temperatures within the range between about 50° and 180° F. Usually atmospheric pressure is employed when polymerizing monomers containing more than 4 carbon atoms in the molecule and elevated pressures are used if the more volatile $C_3$–$C_4$ alpha-olefins are present. The time of reaction will depend upon, and is interrelated to, the temperature of the reaction, the choice of catalyst, and the pressure employed. In general, however, ½ to 5 hours will complete the reaction.

Usually, based upon 100 parts by weight of polymer to be produced, about 120 to 100,000 parts by weight of solvent, and about 0.05 to 5 parts by weight of catalyst will be used in the polymerization.

The Distillate Fuels

The light distillate fuel oils of the invention are those having a viscosity of about 1.6 to 7.5 centistokes at 100° F., having less than 3 wt. %, based on the total weight of the fuel, of n-paraffin wax boiling above 350° C., and wherein the oil boils in the range of about 250° F. to about 950° F., e.g., 300° to about 850°, of which at least about 5 wt. % and frequency 10 wt. % or more, of the oil boils above 700° F., e.g., as measured by ASTM-D-1160. Usually, the viscosity of the fuel will be 3 cs. or less at 100° F. and the fuel will have less than 1 wt. % of said wax boiling above 350° C. These high end point distillate fuels have been found particularly difficult to treat for cold flow improvement, usually requiring large amounts of pour point additives to achieve small effects. Such fuels can be prepared either by regular atmospheric distillation of a relatively thermally stable crude oil to obtain the high end point without excessive cracking, or by applying some vacuum to the distillation tower or even by blending vacuum gas oil boiling up to 900° F., with an atmospheric distillate. In general, these fuels do not respond well to conventional distillate fuel cold flow improvers.

However, such high boiling distillate fuels are of interest, e.g., as diesel fuels, in view of the current tendency and desire to increase the maximum atmospheric distillation temperature of diesel fuels. One advantage of increasing the maximum distillation temperature is that the resulting fuel will then contain a larger proportion of higher molecular weight hydrocarbons, which in turn, increases the BTU value of the fuel. However, raising the maximum distillation point will include longer chain waxes in the fuel and generally will raise the pour point and the cloud point. This, in turn, will usually mean that wax crystals become more of a problem in cold weather, so that the wax crystal size will frequently need to be controlled. Thus in the normal operation of diesel trucks, a fine mesh filter of about 50 microns (which is about equivalent to a 270 mesh screen) is usually provided ahead of the engine. In cold weather, when the ambient temperature is below the cloud point, any wax crystals that form should be sufficiently fine so that they will pass through these filters. It is to this problem of controlling the wax crystal size that the additive combination of the invention is directed.

The high end point fuel oil of the invention can comprise straight run or cracked gas oil, or a blend in any proportion of straight run and thermally and/or catalytically cracked distillates, or blends of middle distillates and heavy distillates, etc.

In measuring the boiling characteristics of these high end point fuels, ASTM-1160 distillation (a distillation under vacuum) can be used and the resulting boiling points are then corrected to boiling points at atmospheric pressure. Alternatively, ASTM Method D-86, which is an atmospheric distillation can be used, but usually some thermal cracking will occur so that the results of the D-86 distillation are less accurate.

The combinations of the invention may be used alone, or in combination with still other oil additives, e.g., corrosion inhibitors; antioxidants; sludge inhibitors; etc.

The invention will be further understood by reference to the following examples which include preferred embodiments of the invention.

EXAMPLES

The following materials were used:

Polymer 1

Polymer 1 was an ethylene-vinyl acetate copolymer having a number average molecular weight of about 3047 as measured by Vapor Pressure Osmometry and containing about 12 wt. % vinyl acetate. This material was prepared as follows:

A three liter stirred reactor was charged with 700 ml. of benzene as solvent and 50 ml. of vinyl acetate. The reactor was then purged with nitrogen and then with ethylene. The reactor was next heated to 105° C. while ethylene was pressured into the reactor until the pressure was raised to 1400 psig. Then, while maintaining a temperature of 105° C. and said 1400 psig pressure, 20 ml/hour of vinyl acetate and 100 ml/hour of solution consisting of 5 wt. % di-lauroyl peroxide dissolved in benzene were continuously pumped into the reactor. A total of 43 ml. of vinyl acetate were thusly injected into the reactor over 2 hours and 5 minutes, while 263 ml. of the peroxide solution (or about 12 gm. of peroxide) were injected into the reactor over a period of 2 hours and 35 minutes. After the last of said peroxide was injected, the batch was maintained at 105° C. for an additional 10 minutes. Then, the temperature of the reactor contents was lowered to about 50° C., the reactor was depressurized, and the contents were discharged from the reactor. The empty reactor was rinsed with 1 liter of warm benzene (about 50° C.), which was added to the product. The product was then stripped of the solvent and unreacted monomers on a steam bath overnight by blowing nitrogen through the product. The final stripped product consisted of about 180 gms. of copolymer of ethylene and vinyl acetate containing 12 wt.% vinyl acetate.

Polymers 2 and 3

These polymers were prepared in a manner similar to that of Polymer 1 except for various differences, e.g., temperature, pressure, relative amounts of reactants, etc.

Polymers 4 and 5

These polymers were polyethylene homopolymers prepared in a manner similar to that of Polymers 1 to 3 with the primary difference that no vinyl acetate was used.

The process conditions used to prepare Polymers 1 to 5 are summarized in Table I, which follows, along with some of the polymer characteristics.

TABLE I

| | ETHYLENE POLYMERS | | | | |
|---|---|---|---|---|---|
| | 1 | 2 | 3 | 4 | 5 |
| Polymer Preparation | | | | | |
| Initiator | DLP | DLP | DLP | TBP | DLP |
| Reaction Temp., °C. | 105 | 95 | 125 | 155 | 125 |
| Reaction Pressure, psig. | 1400 | 1800 | 1400 | 2000 | 1100 |
| Initial Charges, (ml) | | | | | |
| Vinyl Acetate | 50 | 120 | 50 | — | — |
| Benzene | 700 | 700 | 700 | 600 | — |
| Cyclohexane | — | — | — | — | 600 |
| Ethyl Acetate | — | — | — | — | 100 |
| Injection Charges | | | | | |
| Vinyl acetate, ml/hr. | 20 | 25 | 20 | — | — |
| Injection Time for vinyl acetate, minutes | 125 | 120 | 125 | — | — |
| Initiator Solution, ml/hr. | 100[a] | 100[a] | 100[a] | 60[b] | 70[c] |
| Injection Time for initiator | 155 | 120 | 155 | 150 | 155 |
| Soak Time, minutes | 10 | 30 | 10 | 15 | 10 |
| Polymer Properties | | | | | |
| Yield, g. | 180 | 146 | 245 | 400 | 325 |
| Wt. % vinyl acetate | 12 | 20 | 24 | — | — |

TABLE I-continued

| | ETHYLENE POLYMERS | | | | |
|---|---|---|---|---|---|
| | 1 | 2 | 3 | 4 | 5 |
| Mol. weight, (V.P.O.) | 3047 | 3922 | 3412 | 2948 | 948 |

[a]Initiator Solution consisted of 5 wt. % di-lauroyl peroxide (DLP) in 95 wt. % benzene.

[b]Initiator Solution consisted of 12 wt. % t-butyl peroxide (TBP) in 88 wt. % benzene.

[c]Initiator Solution consisted of 23 wt. % di-lauroyl peroxide (DLP) in 77 wt. % of 80% cyclohexane and 20% benzene.

Polymer A

Polymer A was a copolymer of dialkyl fumarate and vinyl acetate in about equi-molar proportions, having a number average molecular weight (VPO) of about 1550. The fumarate was prepared from a mixture of straight chain alcohols averaging about $C_{12}$, of which a typical analysis is as follows: 0.7 wt. % $C_6$, 10 wt. % $C_8$, 7 wt. % $C_{10}$, 47 wt. % $C_{12}$, 17 wt. % $C_{14}$, 8 wt. % $C_{16}$, 10 wt. % $C_{18}$.

Polymer B

This was a copolymer of substantially equal molar amounts of aliphatic $C_8$, $C_{10}$, $C_{14}$ and $C_{16}$ alpha monoolefin prepared as follows:

A reaction flask fitted with a stirrer, thermometer, reflux condenser, hydrogen inlet tube, dropping funnel vented back to the flask and heating mantle, was thoroughly dried and transferred to a dry-box in which was maintained an oxygen-free atmosphere of dry nitrogen. To the flask was added 0.42 grams of AA catalyst, 1.22 ml. of aluminum tripropyl cocatalyst and 90 ml. of dry, purified toluene. The flask was placed in an oil bath at 60° C. while stirring. After it had reached the 60° C. temperature a slow stream of hydrogen was bubbled through the mixture. One-third (56 ml.) of a monomer solution previously added to the dropping funnel consisting of 22.5 ml. octene-1, 26.7 ml. decene-1, 34.85 ml. tetradecene-1 and 38.95 ml. of hexadecene-1, diluted with 45 ml. of purified toluene, was added with stirring. A second 56 ml. was added one-half hour later and the last portion was added at the end of a half hour from said second addition. When the monomer addition was complete, stirring, heating at 60° C. and hydrogen addition was continued for an additional hour. The catalyst was inactivated by the addition of anhydrous isopropyl alcohol in heptane and the polymer precipitated by the addition to a large volume of methanol.

The AA catalyst (Stauffer Chemical Co.) used above has the formula $(TiCl_3)_3.AlCl_3$ and is made by the reduction of 3 moles of $TiCl_4$ with one mole of aluminum. It is a finely ground, or milled, purple powder, has a molecular weight of 596.15, sublimes at 225° C. and shows a close packed hexagonal cubic crystal structure by X-Ray analysis. The cocatalyst used was aluminum tri-n-propyl $Al(n\text{-}C_3H_7)_3$.

Polymer C

This was a copolymer of a $C_{12}$ dialkyl fumarate and a $C_{16}$ methacrylate prepared by copolymerizing 11.3 g. of $C_{12}$ dialkyl fumarate, 7.75 g. of $C_{16}$ alkyl methacrylate and 0.45 g. of methacrylic acid, using 0.2 g. of azoisobutyl nitrile as a polymerization initiator and 8.5 cc. of heptane as solvent, under nitrogen at a temperature of 75° C. for about 6 hours. After evaporation of the solvent, 14.35 g. of polymer was obtained. The alkyl groups of said fumarate and methacrylate ester were straight chain groups.

Polymer D

This was a copolymer of $C_{16}$ dialkyl fumarate and $C_{12}$ alkyl methacrylate prepared by copolymerizing 14.1 g. of $C_{16}$ dialkyl fumarate, 6.65 g. of $C_{12}$ alkyl methacrylate and 0.45 g. of methacrylic acid, using 0.2 of azoiso-butyl nitrile and 9 cc. of heptane, at 70° C. for 6 hours, under nitrogen to give 18.37 g. of polymer product. All of said alkyl groups were straight chain.

Polymer E

A copolymer of a mixed $C_6$ to $C_{18}$ dialkyl fumarate and vinyl acetate was prepared as follows:

A one liter flask equipped with a stirrer, thermometer, dropping funnel and reflux condenser with a nitrogen lead was charged with 100 grams of a mixture of $C_6$ to $C_{18}$ dialkyl fumarate, 40 grams of vinyl acetate, 60 grams of cyclohexane as solvent and 0.5 grams. of tertiary butyl perbenzoate. 170 grams of a light mineral white oil was charged to the dropping funnel. After flushing the system with nitrogen for about 30 seconds, the above mixture was then heated to a reflux temperature of about 77° C. with stirring under a nitrogen atmosphere. Heat was continued for about 19 hours over a period of 3 days after which the heat was turned off. The 0.5 grams of paramethoxy phenol was added as a polymerization inhibitor and 170 grams of additional white oil was added to the flask. The contents of the flask was removed into a beaker and washed with hexane. The material was then placed on a steam table with nitrogen blowing overnight in order to remove the solvent. A total of 285.7 grams of polymer was prepared.

The aforesaid mixture of $C_6$ to $C_{18}$ fumarate was a mixture of straight chain alkyl fumarate comprising about 4.2 grams of $C_6$ fumarate; 6.2 grams of $C_8$ fumarate; 7.3 grams of $C_{10}$ fumarate; 43.7 grams of tallow fumarate made from tallow alcohol and 38.6 grams of Lorol B fumarate made from Lorol alcohol, which is a commercial mixture of coconut oil alcohols averaging about a $C_{12}$ alcohol.

Polymers A to E are summarized in Table II which follows along with actual or estimated molecular weight:

TABLE II

| Polymer | The Second Polymer TYPE |
|---|---|
| A | $C_6N_{18}$ Dialkyl Fumarate-Vinyl Acetate - $\overline{M}_n$ of 1550 by VPO. |
| B | $C_8$, $C_{10}$, $C_{14}$, $C_{16}$ Olefin Copolymer - $\overline{M}_n$ estimated about 5000. |
| C | $C_{12}$ Dialkyl Fumarate - $C_{16}$ Methacrylate - $\overline{M}_n$ estimated about 5000. |
| D | $C_{16}$ Dialkyl Fumarate - $C_{12}$ Methacrylate - $\overline{M}_n$ estimated about 5000. |
| E | $C_6NC_{18}$ Dialkyl Fumarate-Vinyl Acetate - $\overline{M}_n$ estimated 2000–2400. |

The Fuels

Properties of the Fuels tested are summarized in Table III, which follows.

TABLE III

| | FUELS | | | | | |
|---|---|---|---|---|---|---|
| | I | | II | | III | IV |
| Properties | | | | | | |
| Gravity at 60° F. | 36.5 API | | 37.8 API | | 0.8132 | — |
| Cloud Point, °F. | 28 | | 40 | | — | 26 |
| Aniline Point °C. | 150° F. | | 165° F. | | — | 166.5° F. |
| Distillation, °F. | D-86 | D-1160 | D-86 | D-1160 | D-86 | D-86 |
| IBP | 324 | 322 | 366 | 353 | 338 | 350 |
| 5% | 381 | 358 | 401 | 384 | 361 | 406 |
| 10% | 398 | 387 | 414 | 397 | 374 | 420 |
| 30% | | | | | | 462 |
| 50% | 529 | 540 | 526 | 544 | 468 | 516 |
| 70% | | | | | | 562 |
| 90% | 710 | 736 | 697 | 733 | 608 | 614 |
| 95% | 748 | 778 | 730 | 779 | 617 | 649 |
| F.B.P. | 758 | 789 | 744 | 847 | 651 | 666 |
| n-Paraffin range | Up to $C_{34}$ | | Up to $C_{40}$ | | $C_{10-24}$ | $C_{13-26}$ |

Fuels I and II represent the high end point middle distillate fuels of the invention, while Fuels III and IV are conventional middle distillate fuels. Fuels I to IV all had viscosities in the range of about 2 to 3 centistokes at 100° F. Fuels I and II each contained 0.5 wt. %, or less (based on the weight of the fuel) of n-paraffin wax boiling above 350° C.

Various blends of Polymers 1 to 5 with Polymers A to E in Fuels I to IV were made by simply dissolving the polymer in the fuel oil. This was done while warming, e.g., heating the oil and polymer to about 200° F. if the polymer per se was added, and stirring. In other cases, the polymer was simply added with stirring to the fuel in the form of an oil concentrate which was usually about 50 wt. % polymer dissolved in a light mineral oil.

The blends were then tested for their cold flow properties in the test described below.

The Cold Filter Plugging Point Test (CFPPT)

The cold flow properties of the blend were determined by the Cold Filter Plugging Point Test (CFPPT). This test is carried out by the procedure described in detail in "Journal of the Institute of Petroleum", Volume 52, Number 510, June 1966, pp. 173–185. In brief, the Cold Filter Plugging Point Test is carried out with a 45 ml. sample of the oil to be tested which is cooled in a bath maintained at about −30° F. Every two degrees drop in temperature, starting from 4° F. above the cloud point, the oil is tested with a test device consisting of a pipette to whose lower end is attached an inverted funnel. Stretched across the mouth of the funnel is a 350 mesh screen having an area of about 0.45 square inch. A vacuum of about 7" of water is applied to the upper end of the pipette by means of a vacuum line while the screen is immersed in the oil sample. Due to the vacuum, oil is drawn across the screen up into the pipette to a mark indicating 20 ml. of oil. The test is repeated with each two degrees' drop in temperature until the oil fails to fill the pipette to the aforesaid mark due to clogging of the screen with wax crystals. The results of the test are reported as the temperature in °F. at which the oils fail to fill the pipette in the prescribed time.

The blends prepared and the test results are summarized in Tables IV to VII which follow.

TABLE IV

| EFFECTIVENESS OF POLYMERS IN FUEL I OF THE INVENTION | |
|---|---|
| POLYMER | CFPPT, ° F. |
| None | 28 |
| .01% Polymer A | 30 |
| .0075% Polymer A<br>.0025% Polymer 4 | 8 |
| .0075% Polymer A<br>.0025% Polymer 5 | 10 |
| .005% Polymer A<br>.005% Polymer 3 | 8 |
| .0075% Polymer B<br>.0025% Polymer 2 | 4 |
| .01% Polymer E | 24 |
| .005% Polymer E<br>.005% Polymer 5 | 12 |

TABLE V

| EFFECTIVENESS OF POLYMERS IN FUEL II OF THE INVENTION | |
|---|---|
| POLYMER | CFPPT, °F. |
| None | 36 |
| .03 wt. % Polymer C | 18 |
| .0225% Polymer C<br>.0075% Polymer 2 | 10 |
| .03% Polymer D | 36 |
| .0225% Polymer D<br>.0075% Polymer 2 | 24 |
| .015% Polymer A<br>.015% Polymer 1 | 12 |

TABLE VI

| EFFECT OF POLYMERS IN CONVENTIONAL FUEL III | |
|---|---|
| POLYMER | CFPPT, °F. |
| None | 16 |
| .03% Polymer A | 14 |
| .0225% Polymer A<br>.0075% Polymer 5 | 14 |
| .015% Polymer A<br>.015% Polymer 3 | 16 |
| .0225% Polymer B<br>.0075% Polymer 2 | 16 |
| .03% Polymer E | 14 |
| .0225% Polymer E<br>.0075% Polymer 5 | 14 |

TABLE VII

| EFFECT OF POLYMERS IN CONVENTIONAL FUEL IV | |
|---|---|
| POLYMER | CFPPT, °F. |
| None | 24 |
| .03% Polymer A | 22 |
| .0225% Polymer A<br>.0075% Polymer 4 | 20 |
| .0225% Polymer A<br>.0075% Polymer 5 | 20 |
| .015% Polymer A<br>.015% Polymer 3 | 18 |
| .0225% Polymer C<br>.0075% Polymer 2 | 21 |
| .03% Polymer D | 23 |
| .0225% Polymer D | 23 |

TABLE VII-continued

| EFFECT OF POLYMERS IN CONVENTIONAL FUEL IV | |
|---|---|
| POLYMER | CFPPT, °F. |
| .0075% Polymer 2 | |

As seen by Table IV, Fuel I per se, with no polymer clogged the fine mesh screen and failed the test at 28° F. Adding 0.01 wt. % Polymer A did not improve the oil and in fact resulted in a failure at 30° F. However, combining 0.0075 wt. % Polymer A with 0.0025% Polymer 4 reduced the size of the wax crystals so that plugging of the test screen did not occur until a temperature of 8° F. was reached. Similarly, Polymer E had only a little effect on improving the oil, while combinations of Polymer E with the ethylene type polymers, e.g., Polymer 5, resulted in a good improvement in th cold temperature flow characteristics of the oil.

Similar results are shown in Table V with other Polymer combinations, while Tables VI and VII show that in conventional middle distillate fuels, the polymer combinations have little effects. Thus, while the combination of Polymers A and 4 was very effective in high end point Fuel I (Table IV), the same combination, in an even higher concentration, was only slightly effective in Fuel IV (Table VII) where it reduced the screen plugging point only from 24° to 20° F. Similarly, the combination of Polymers A and 5 was effective in Fuel I, but had little effect in the conventional Fuels III and IV.

What is claimed is:

1. A fuel composition comprising a fuel consisting of wax-containing middle distillate pertroleum light fuel oil boiling in the range of 250° to 900° F., having a viscosity of 1.6 to 7.5 centistokes at 100° F., having less than 1 wt. %, based on the total weight of the fuel, of n-paraffin wax boiling above 350° C., and of which at least 5 wt. % of said oil boils above 700° F. according to ASTM-D-1160, which oil has been improved in its low temperature flow properties, said oil containing in the range of about 0.005 to 0.1 wt. %, based on the weight of the total composition, of a synergistic flow improving combination of one part by weight of an oil soluble ethylene backbone middle distillate pour point depressing polymer having a number average molecular weight in the range of about 1000 to 6000 per (b) 0.2 to 4 parts by weight of a second oil soluble polymer having a number average molecular weight in the range of about 1000 to 100,000;

wherein said ethylene backbone polymer is selected from the group consisting of branched polyethylene, and copolymers consisting essentially of 4 to 20 molar proportions of ethylene with a molar proportion of ethylenically unsaturated alkyl ester of the formula:

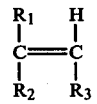

wherein $R_1$ is hydrogen or methyl; $R_2$ is a —$OOCR_4$ or —$COOR_4$ group wherein $R_4$ is a $C_1$ to $C_4$ alkyl group, and $R_3$ is hydrogen, and mixtures of said comonomers, and wherein said second polymer is a polymer selected from the group consisting of:

(a) ester copolymers consisting of dialkyl fumarate copolymerized with 5 to 70 mole % of a comonomer selected from the group consisting of vinyl acetate and alkyl methacrylate, wherein said alkyl groups of said fumarate and said methacrylate consist essentially of $C_6$ to $C_{16}$ straight chain alkyl groups; and (b) polymers consisting essentially of $C_8$ to $C_{18}$ alpha monoolefin moieties.

2. A fuel composition according to claim 1, wherein said ethylene backbone polymer is a copolymer of ethylene and a vinyl alcohol ester of a $C_1$ to $C_4$ saturated aliphatic monocarboxylic acid.

3. A fuel composition according to claim 1, wherein said ethylene backbone polymer is said polyethylene.

4. A fuel composition according to claim 1, wherein said second polymer is said copolymer of dialkyl fumarate and vinyl acetate.

5. A fuel composition according to claim 1, wherein said second polymer is a copolymer of $C_8$, $C_{10}$, $C_{14}$ and $C_{16}$ alpha monoolefins.

6. A fuel composition according to claim 1, wherein said second polymer is a copolymer of dialkyl fumarate and an alkyl methacrylate wherein said alkyl groups of said fumarate and said methacrylate contain about 12 to 16 carbon atoms.

7. A fuel composition according to claim 1, wherein said fuel has a viscosity of about 2 to 3 centistokes at 100° F. and said ethylene backbone polymer is a copolymer of ethylene and vinyl acetate having a number average molecular weight in the range of about 1000 to 6000.

8. A fuel composition according to claim 7, wherein said second polymer is a copolymer of a dialkyl fumarate and vinyl acetate.

9. A fuel composition according to claim 7, wherein said second polymer is a copolymer of $C_8$, $C_{10}$, $C_{14}$, and $C_{16}$ alpha monoolefins.

10. A fuel composition according to claim 7, wherein said second polymer is a copolymer of a dialkyl fumarate and an alkyl methacrylate, and wherein said alkyl groups of said fumarate and said methacrylate contain about 12 to 16 carbon atoms.

* * * * *